US006334351B1

(12) United States Patent
Tsuchiya

(10) Patent No.: US 6,334,351 B1
(45) Date of Patent: Jan. 1, 2002

(54) METAL PIPE EXPANDER

(75) Inventor: Masaki Tsuchiya, Yokkaichi (JP)

(73) Assignee: Daido Tokushuko Kabushiki Kaisha, Aichi (JP)

( * ) Notice: Subject to any disclaimer, the term of this patent is extended or adjusted under 35 U.S.C. 154(b) by 0 days.

(21) Appl. No.: 09/706,712

(22) Filed: Nov. 7, 2000

(30) Foreign Application Priority Data

Nov. 8, 1999 (JP) ..... 11-316201

(51) Int. Cl.[7] ..... B21D 3/14; B21B 17/06
(52) U.S. Cl. ..... 72/370.06; 29/402.01
(58) Field of Search ..... 72/75, 370.01, 72/370.06, 453.1, 479; 29/402.01

(56) References Cited

U.S. PATENT DOCUMENTS 4,005,591 A * 2/1977 Werner ..... 72/75

* cited by examiner

*Primary Examiner*—David Jones
(74) *Attorney, Agent, or Firm*—Bacon & Thomas, PLLC

(57) ABSTRACT

A metal pipe expander which is inserted into a metal pipe and driven to move in the axial direction of the metal pipe by a liquid pressure has an expanding section and a pressure receiving section. The expanding section has a conical portion of which a small diameter portion is directed to a front side. The pressure receiving section has a cup shaped portion opened to the rear side, the outer surface of which is in slide contact with an inner surface of the metal pipe after it is expanded in diameter. The pressure receiving section is provided at a rear end of an expanding section.

10 Claims, 4 Drawing Sheets

METAL PIPE EXPANDER

BACKGROUND OF THE INVENTION

1. Field of the Invention

The present invention relates to a metal pipe expander for uniformly expanding a metal pipe in its inner diameter.

2. Description of the Related Art

In a known conventional method for uniformly expanding of the inner diameter of a steel pipe of relatively short length, the rear end of a tapered metal pipe expander (mandrel) shaped like a short cylinder, which has been inserted into a steel pipe, is pushed inward with mechanical means such as a shaft to move forward the metal pipe expander in the axial direction within the steel pipe, or the metal pipe expander is rotated while being moved, whereby the steel pipe is expanded.

However, the pipe expanding method does not function well in expanding a long metal pipe, e.g., an oil well pipe extending several hundreds meters to several kilometers. When the method is used for expanding such a long metal pipe, the shaft for driving forward the metal pipe expander suddenly buckles. For this reason, it is remotely possible to employ the expanding method. For this reason, to expand such a long metal pipe in diameter, the following pipe expanding method is used. Liquid, e.g., water, after pressurized, is supplied into the metal pipe. A liquid pressure generated is applied to the rear end face of the metal pipe expander, and the propel force caused by the liquid pressure drives forward the metal pipe expander, thereby expanding the steel pipe in diameter.

However, the liquid-pressure basis expanding method has also the following serious problem. During the expanding operation, the metal pipe is often broken (burst) at a position near the metal pipe expander located by the liquid pressure for driving forward the metal pipe expander. Particularly, in the case of the oil well pipe, if the bursting accident occurs at a deep place in the earth, it is impossible to repair the broken, long oil-well pipe unless it is dug out of the ground. This presents a serious problem.

SUMMARY OF THE INVENTION

It is an object of the present invention to provide a metal-metal pipe expander which can prevent the metal pipe from being broken by reducing a force exerting on the metal pipe during the pipe expanding operation.

To achieve the above object, the inventor of the present invention analyzed forces exerting on a metal pipe when the metal pipe is expanded by using the metal pipe expander. The analysis will be described with reference to FIG. 4. As shown, a metal pipe expander 41, shaped like a conic body, is inserted into a metal pipe 10, and moved forward (in the direction of an arrow X) for pipe expansion by a liquid pressure. At this time, an expanding force F acts on an expanded part 13 of the metal pipe 10, which is under deformation by the press fitting of the a conical surface 41*a* of the metal pipe expander 41. Also at this time, an expanded portion 10*a* of the metal pipe receives a tension T which has a direction coincident with a longitudinal direction of the pipe and corresponds to the propel force of the metal pipe expander 41, and an internal force R which results from a liquid pressure "p" causing the propel force. Those three forces act on an expansion-terminating position 14 of the pipe and therearound in a complex manner. As a result, excessive stress is generated and the pipe is easy to be broken thereat. This fact was found and confirmed by the inventor. Further, the inventor carefully examined the metal pipes broken when those pipes were expanded. From the examination, it was found that many broken pipes were broken while being greatly bent. From this fact, it is estimated the cause of the breakage of the metal pipe as follows: The deviation of the wall thickness of the metal pipe and the like cause the metal pipe to bend during its expanding operation. The bending of the metal pipe progressively grows. A great bending stress is locally generated and is added to the stress caused by the three forces including the expanding force F and the like. As a result, the metal pipe is easy to be broken.

The present invention was made based on the findings mentioned above, and prevents excessive stress from acting on the metal pipe by blocking the exerting of the internal force R on the expansion-terminating position 14 and therearound or by the internal force blocking and by restricting the bending of the metal pipe associated with the pipe expanding operation.

According to the present invention, there is provided a first metal pipe expander which is inserted into a metal pipe and driven to move in the axial direction of the metal pipe by a liquid pressure, wherein a cup shaped portion opened to the rear side, the outer surface of which is in slide contact with the inner surface of the metal pipe after it is expanded in diameter, is provided at the rear end of an expanding section with a conical portion of which the small diameter portion is directed to the front side.

In the description to follow, the term "fore" side means the fore side as viewed in a direction in which the metal pipe expander advances when the pipe is expanded. The term "rear" side means the side opposite to the fore side.

In the first metal pipe expander, a liquid pressure of pressurized liquid supplied into the metal pipe acts on the rear end of a cup shaped portion of the pressure receiving section of the metal pipe expander, to thereby drive and move forward the expanding section integral with the pressure receiving section to expand the metal pipe. At this time, the liquid pressure is sealed with a sliding contact portion between the outer surface of the cup shaped portion and the inner surface of the expanded metal pipe. Therefore, there is no chance that an internal force R caused by the liquid pressure acts on the inner surface of the metal pipe located on the fore side. Accordingly, the internal force R does not exert on the expansion-terminating position and therearound of the metal pipe. As a consequence, an excessive stress is not generated in the metal pipe.

One pressure receiving section may be used for the pressure receiving section located on the rear side of the expanding section. A plurality of the pressure receiving sections may be provided while being longitudinally and contiguously arranged as in the second metal pipe expander. In this case, even if, by wear of the outer surface of the cup shaped portion of the pressure receiving section, the sealing between it and the inner surface of the metal pipe is damaged, the sealing of the outer surface of the cup shaped portion of the pressure receiving section located on the fore side, reliably blocks application of the internal force R to the expansion-terminating position 14 and its near portion of the expanded metal pipe. In this regard, the construction of the second metal pipe expander is preferable. Further, during and after the pipe expanding operation, the metal pipe is supported at a total of three locations linearly arrayed, the expanding section and the plurality of cup shaped portions of the pressure receiving sections. Therefore, the bending of the metal pipe caused when the pipe is expanded is controlled to be extremely small. As a result, the breakage of the metal pipe owing to this bending is reliably prevented. In this respect, the construction of the second metal pipe expander is more preferable.

Also in the third metal pipe expander in which a guide portion is further provided between the expanding section and the pressure receiving section in a state that the guide portion is in slide contact with the inner surface of the metal pipe after it is expanded, during and after the pipe expanding operation, the metal pipe is supported at a total of at least three locations, the expanding section and one or the plurality (in the case of the second metal pipe expander) of cup shaped portions. Therefore, the bending of the metal pipe caused when the pipe is expanded is controlled to be extremely small. As a result, the breakage of the metal pipe owing to this bending is reliably prevented. In this respect, the construction of the third metal pipe expander is preferable.

In the fourth metal pipe expander in which a guide portion with a fitting part is further provided on the fore side of the expanding section, the fitting part being brought into press contact with the inner surface of the metal pipe at a position spaced apart from the expanding section, the fitting part of the guide portion is brought into press contact with the inner surface of the metal pipe before it is not yet expanded, so that an inclination of the axial line of the expanding section with respect to the axial line of the metal pipe not yet expanded is controlled to be extremely small. This technical feature also reduces the bending of the metal pipe by the pipe expansion, and prevents the breakage of the metal pipe owing to this bending. In this regard, the construction of the fourth metal pipe expander is preferable.

PREFERRED EMBODIMENTS OF THE INVENTION

Preferred embodiments of the present invention will be described as follows referring to the accompanying drawings.

Figure 1:
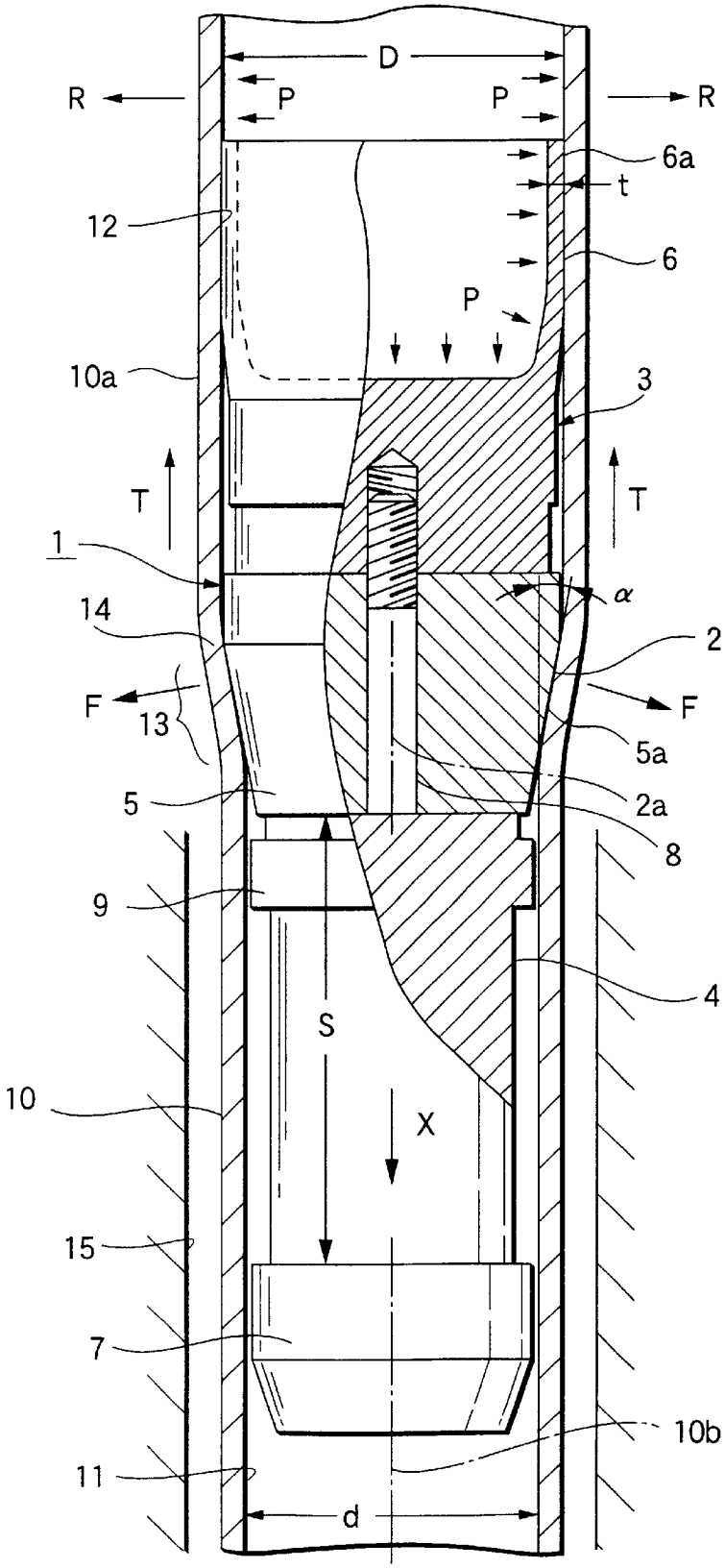
FIG. 1 is a side view, broken in part, showing a metal pipe expander, while being in use, which is a first embodiment of the present invention.

A metal pipe expander according to a first embodiment of the present invention will be described with reference to FIG. 1. In the figure, reference numeral 1 designates a metal pipe expander for expanding a metal pipe 10 as an oil well pipe in diameter. In the metal pipe expander, a pressure receiving section 3 is contiguous to the rear side of the expanding section 2. A guide section 4 is contiguous to the fore side of the expanding section 2. The expanding section 2 made of steel includes a conical portion 5 of the vertical angle of $2\alpha$, of which the small diameter side is located on the fore side of the expanding section. A conical surface 5*a* of the conical portion is hardened by quenching.

The pressure receiving section 3 is made of steel having an elasticity, and includes a cup shaped portion 6 opened to the rear side. A rear end 6*a* of the cup shaped portion 6, which gradually increases its diameter toward the rear side, has an outer diameter which is equal to or somewhat (e.g., 0 to 0.5 mm) smaller than the diameter of the large diameter side of the conical portion 5 so that it slidably contacts with an inner surface 12 of the expanded portion 10*a* of the metal pipe 10 (Note: a portion of the metal pipe 10 through which the conical portion 5 passed reduces its diameter because of its elastic deformation, and therefore if the outer diameter of the rear end of the cup shaped portion is so selected, the slidable contact of the rear end with the inner surface is ensured.) Incidentally, it is preferable that a thickness "t" of the cup shaped portion 6 is thinner than that of the expanded portion 10*a*. If so selected, the cup shaped portion 6 is elastically deformed by the liquid pressure, so that it is easy to be in press contact with the inner surface 12. The outer surface of the cup shaped portion 6, which comes in slide contact with the inner surface 12, is preferably subjected to a surface treatment (e.g., plastic coating) in order to secure a wear proof thereof. If required, a strip-like ring made of ceramics or plastic (not shown) may be fit to the outer surface of the cup shaped portion. The entire of the pressure receiving section 3 or the cup shaped portion 6 thereof may be made of elastic material, e.g., rubber, other than metal.

The guide section 4 is made of steel and provided with a fitting head 7. The fitting head 7 is located in front of the expanding section 2, and will be fit into the metal pipe in a state that a slight gap (e.g., 1 to 2 mm at one side) is present between it and the inner surface 11 of the metal pipe 10 before it is expanded. The guide section 4 is shaped like a cylindrical rod with a step. In this embodiment, a threaded bar 8, while being integral with the guide section 4, is extended from the rear end of the guide section. The threaded bar 8 of the guide section is passed through a center hole of the expanding section 2 and screwed into a threaded hole formed in the pressure receiving section 3, whereby those component parts are coupled together. A distance S of the fitting head 7 measured from the expanding section 2 (exactly the conical portion 5) of the fitting head 7 is selected to preferably be 1.5 times or more as long as the inner diameter "d" of the metal pipe 10. If the former is selected to be less than 1.5 times as long as the latter, the control of an inclination of the axial line of the expanding section 2, which will be described later, could be unsatisfactory. Reference numeral 9 designates a second fitting portion, which is provided at a position closer to the expanding section 2 whenever occasion calls. It is fit into the metal pipe 10 in a state that a slight gap is present between it and the inner surface 11 of the metal pipe.

The thus constructed metal pipe expander 1 is used for expanding the metal pipe 10 in diameter in a manner that it is inserted into the metal pipe 10, and then a liquid pressure is applied to the rear side of the metal pipe expander. This will be described for a case where as in this instance, the metal pipe 10 is an oil well pipe and a casing is formed along a well bore 15 by the expanding the pipe. A long metal pipe 10 is formed in a manner that the end faces of a number of steel pipes are butted and an insert material is interposed between the end faces to be bonded, and the butted portion is bonded by the liquid phase diffusion process. The inner surface of the thus formed metal pipe 10 is coated with lubricant such as oil or $MOS_2$, upon occasion. Then, the resultant is inserted into and set in the well bore 15. Thereafter, the metal pipe expander 1 is inserted into an expanded portion (not shown) formed in advance at the foremost end of the metal pipe 10 in a state that the guide section 4 thereof is directed downward. Then, the upper end of the expanded portion is closed with a cover or the like. Following this, a liquid pressure (water pressure) is applied to the rear end face (upper surface) of the pressure receiving section 3 by supplying pressurized water thereto by a hydraulic pump, whereby the metal pipe expander 1 is hydraulically driven to expand the metal pipe in diameter.

The metal pipe expander 1 moves forward (descends) in the direction of an arrow X within the metal pipe 10 by the hydraulic pressure. With the movement, the fitting head 7 of the guide section 4, which moves ahead, is fit into the metal pipe 10 before it is expanded and brought into contact with the inner surface 11 thereof. Therefore, an inclination of the axial line 2*a* of the expanding section 2 with respect to the axial line 10*b* of the metal pipe 10 is controlled to be extremely small. Accordingly, in the expanding operation by the expanding section 2 that comes after the guide section 4 in the movement, the metal pipe is expanded substantially uniformly expanded along the circumference thereof. As a result, bending of the metal that will be caused after it is expanded is controlled to be extremely small.

A liquid pressure "p" acting on the rear end of the pressure receiving section 3 drives the metal pipe expander 1 to move forward. With the movement, the conical portion 5 of the expanding section 2 forcibly moves forward within and along the metal pipe 10 to expand the metal pipe 10 in diameter such that the diameter "d" of the metal pipe 10 is increased to the diameter D. At this time, an expanding force F for the expanding (plastic deformation) vertically acts on the conical surface 5*a* at the expanded part 13 of the metal pipe 10, and a tension T corresponding to the propel force by the liquid pressure acts on the expanded portion 10*a* of the expanded metal pipe, which is located on the rear side of the expanded part 13 (on the upper side in the case of the oil well pipe). Those points are the same as in a case of FIG. 2.

With regard to the pressure receiving section 3 which receives the liquid pressure P, the rear end 6*a* of the cup shaped portion 6 is in a slide contact with the inner surface 12 of the expanded portion 10*a* of the metal pipe. A rear end part of the cup shaped portion 6 is elastically deformed by the liquid pressure P to be brought into press contact with the inner surface 12. Accordingly, the liquid pressure "p" is blocked with the inner surface 12 and the outer surface of the cup shaped portion 6. As a result, the internal force R acts only on the expanded portion 10*a,* which is located closer to the rear side (upper side) than the cup shaped portion 6, in the radially expanding direction. The internal force R does not act on the expansion-terminating position 14 and therearound in the expanded part 13 of the metal pipe 10. As a result, a force acting on the expansion-terminating position 14 and its vicinity is reduced by the internal force R when comparing with that in the case shown in FIG. 2. For this reason, the metal pipe 10 is prevented from being broken.

Figure 2:
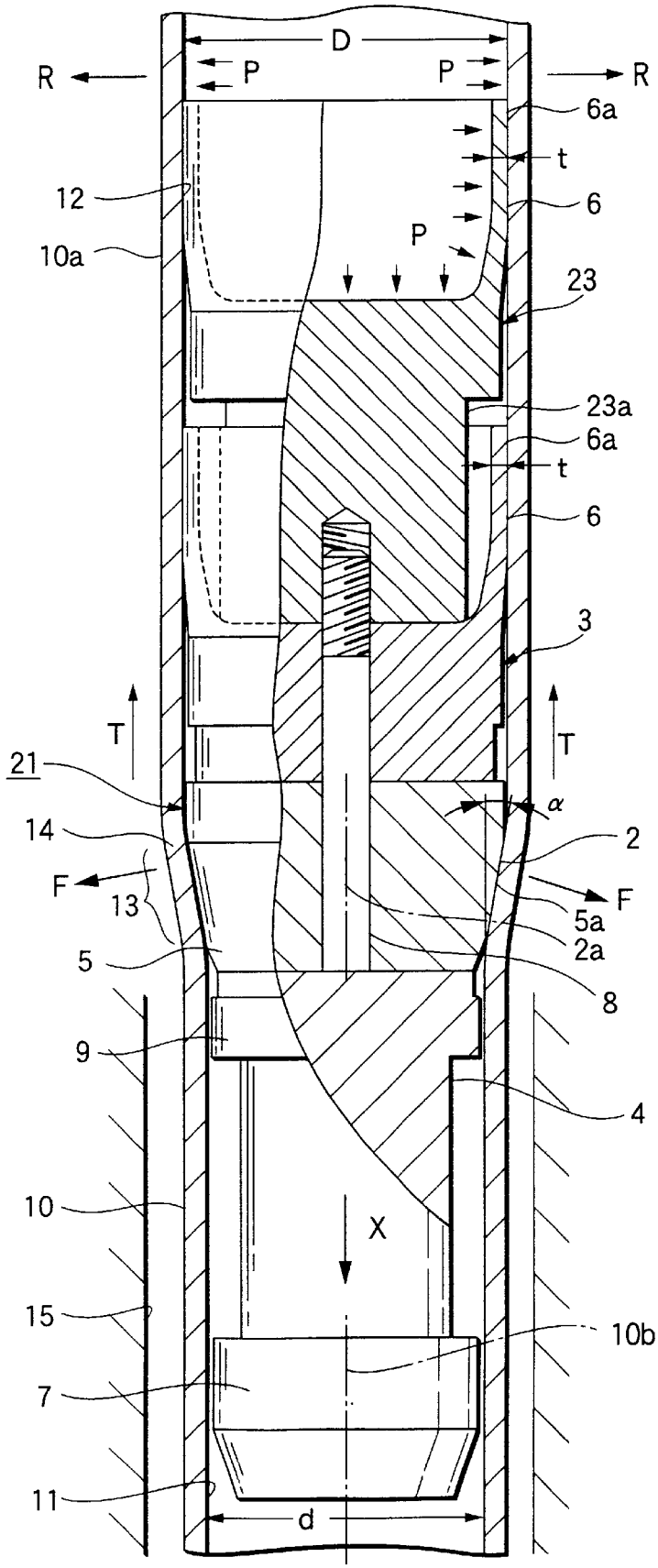
FIG. 2 is a side view, broken in part, showing a metal pipe expander, while being in use, which is a second embodiment of the present invention.

FIG. 2 shows second embodiment of the present invention. In the figure, like or equivalent portions are designated by like reference numerals in FIG. 1 (The same thing is correspondingly applied to other embodiment descriptions to follow.). In a metal pipe expander 21 of this embodiment, a pressure receiving section 23, which is the same in structure as the pressure receiving section 3 except that its leg 23*a* is long, is contiguous to the rear side of the pressure receiving section 3. The remaining structure of the metal pipe expander 21 is the same as of the metal pipe expander 1 of the first embodiment as described above. A couple of the pressure receiving sections 3 and 23, which are longitudinally and contiguously arranged, are disposed on the rear side of the expanding section 2. A threaded bar 8 projected from the guide section 4 is passed through the center of the expanding section 2 and the pressure receiving section 3, and screwed into a threaded hole formed in the pressure receiving section 23, whereby those component parts are coupled into a single unit.

The metal pipe expander 21 is inserted into the metal pipe 10, and a liquid pressure "p" is applied to the rear side of the metal pipe expander. Then, the liquid pressure "p" acting on the rear end of the pressure receiving section 23 propels the metal pipe expander 1, and the expanding section 2 expands the metal pipe 10 in diameter. At this time, the internal force R acts only the expanded portion 10*a* located closer to the rear side than the cup shaped portion 6, and an amount of inclination of the expanding section 2 is lessened to be small by the guide section 4. Those points are the same as in the first embodiment.

Further, in the second embodiment, the pressure receiving sections 3 and 23 are longitudinally arranged in a contiguous fashion. Therefore, even if, by wear of the outer surface of the cup shaped portion 6 of the pressure receiving section 23 and the like, sealing between it and the inner surface of the metal pipe is damaged, the sealing of the outer surface of the cup shaped portion 6 of the pressure receiving section 3 located on the fore side, which slidably contacts with the inner surface 12 of the expanded portion 10*a* of the metal pipe, blocks application of the internal force R to the expansion-terminating position 14 and its near portion of the metal pipe 10. Accordingly, the breakage of the metal pipe 10 is reliably prevented. During and after the pipe expanding operation, the metal pipe 10 is supported at a total of three locations linearly arrayed, the expanding section 2 and the cup shaped portions 6 and 6 of the pressure receiving sections 3 and 23. Therefore, the bending of the metal pipe 10 caused when the pipe is expanded, for example, by the deviation of the wall thickness of the metal pipe is controlled to be extremely small. As a result, there never occurs such an unwanted situation that the stress caused by the bending excessively grows and eventually the metal pipe 10 will be broken.

Figure 3:
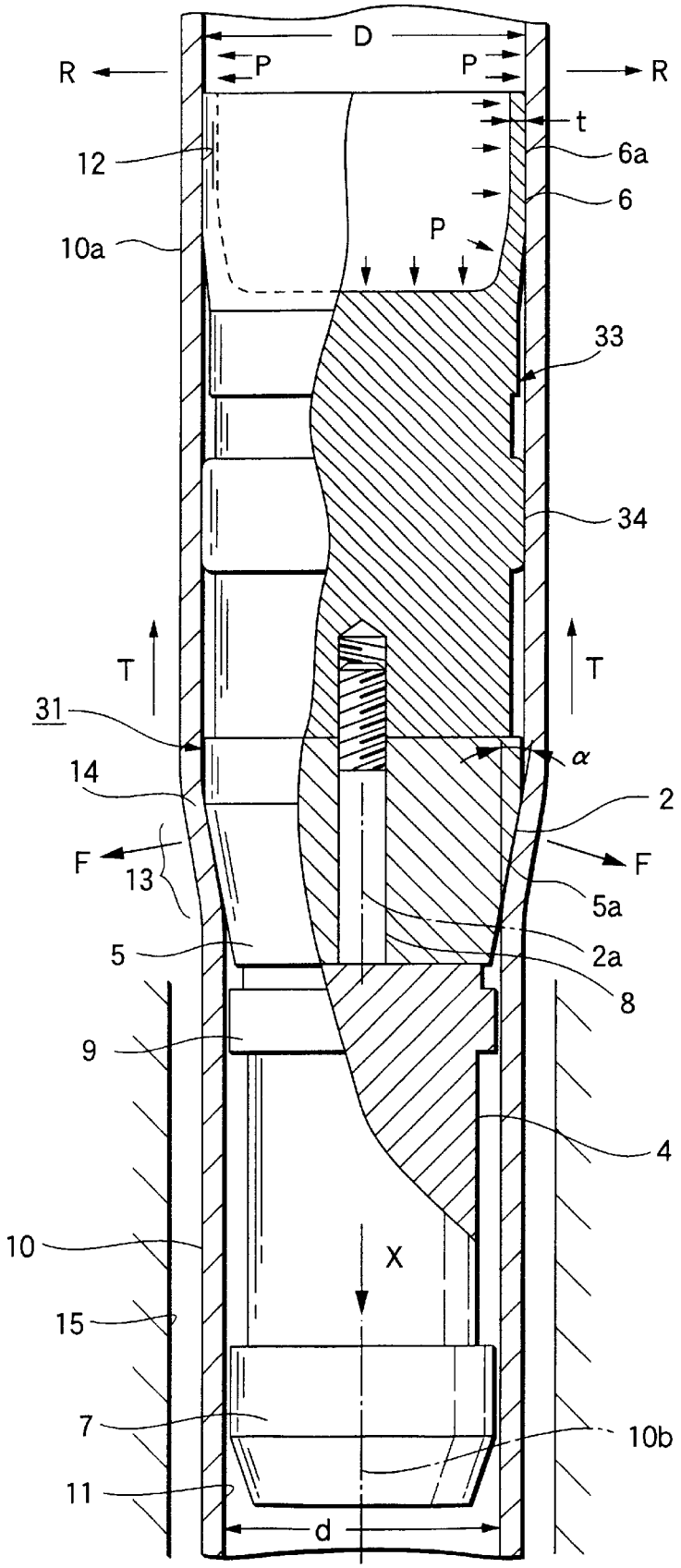
FIG. 3 is a side view, broken in part, showing a metal pipe expander, while being in use, which is a third embodiment of the present invention.
Figure 4:
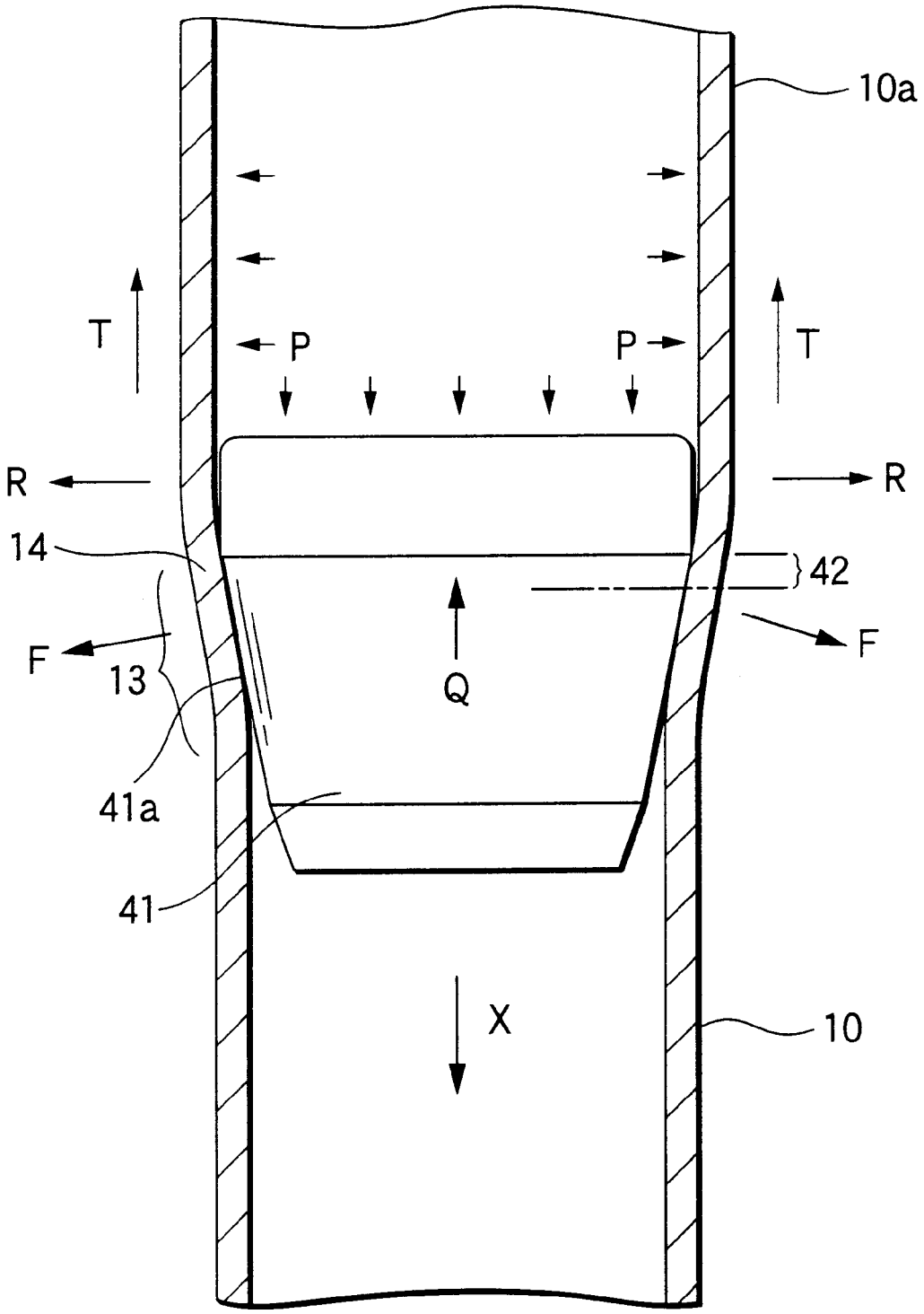
FIG. 4 is a longitudinally sectional view showing a part of a metal pipe at which a conventional metal pipe expander operates for pipe expansion.

FIG. 3 shows a third embodiment of the present invention. In the structure of a metal pipe expander 31 of the embodiment, a guide portion 34, which is in sliding contact with the inner surface of the metal pipe 10, is characteristically provided at a mid position of a long pressure receiving section 33 having a cup shaped portion 6 at the rear end. The remaining structure of the metal pipe expander is the same as of the metal pipe expander 1 of the first embodiment as described above. The guide portion 34, like the rear end 6*a* of the cup shaped portion 6, has the outer diameter equal to or somewhat (e.g., 0 to 05. mm) smaller than the diameter of the large diameter side of the conical portion 5 of the expanding section 2. The outer surface of the guide portion 34, thus dimensioned, will slidably contact with the expanded portion 10*a* of the metal pipe 10 after expanded.

To expand the metal pipe 10 in diameter, the metal pipe expander 31 is inserted into the metal pipe 10 and as in the each embodiment mentioned above, a liquid pressure "p" is applied to the rear end of the metal pipe expander, as in each embodiment mentioned above. Also in this embodiment, the sealing by the cup shaped portion 6 of the pressure receiving section 33 is secured in addition to the control of an inclination of the expanding section 2, which is achieved by the guide section 4. Further, during and after the pipe expanding operation, the metal pipe 10 is supported at a total of three locations linearly arrayed, the expanding section 2, the guide portion 34 of the pressure receiving section 33, and the cup shaped portion 6. Accordingly, as in the second embodiment, the bending of the metal pipe 10 produced when the pipe is expanded is controlled to be extremely small. The breaking of the metal pipe 10, caused by this bending is prevented, as a matter of course.

In the third embodiment, the guide portion 34 is formed integrally with the long pressure receiving section 33 while being located at the mid position of the pressure receiving section. In an alternative, guide means including the guide portion 34 is coupled between a short pressure receiving section 3 (see FIG. 1) and the expanding section 2, while being separate from the pressure receiving section 3. In another alternative, the guide portion 34 may be formed integral with the expanding section 2.

EXAMPLES

Experiments were conducted. In the experiments, ten metal pipes were expanded in diameter under the conditions given below by using the metal pipe expanders 1 and 21 of the first and second embodiment. For comparison, those pipes were expanded in diameter under the same conditions by using the metal pipe expander 1 of which the pressure receiving section 3 alone is removed. The results of the experiments are shown in Table 1. In the table, the term "bending after expanded" means a maximum gap produced between the bending side of an expanded metal pipe and a square of 1 m long that is put on the bending side. The "bending" and a "water pressure" when the pipe is expanded are each an average value of the measured values on those ten metal pipes.

Conditions

Metal pipe: ASTM (American Society for Testing Material) A106 of high tensile low alloy seamless pipe; inner diameter =127 mm, thickness=6.35 mm and Length=6 mm Metal pipe expander : example 1=metal pipe expander 1, example 2=metal pipe expander 21, vertical angle $2\alpha$ of the conical portion 5 of the metal pipe expander=10°

Expanding velocity=25 m/min

TABLE 1

| Items | Example 1 | Example 2 | Comparative Example |
|---|---|---|---|
| Expansion Result | | | |
| Good | 9 | 10 | 5 |
| Broken | 1 | 0 | 5 |
| Water pressure when expanded (Mpa) | 25 | 30 | 40 |
| Bending after Expanded (mm) | 2~8 | 1 or less | 5~10 |

As seen from Table 1, in the examples 1 and 2, the number of the broken metal pipes when those are expanded in diameter is reduced when comparing with those of the comparison not using the pressure receiving section. From this, it is seen that the breakage of the metal pipes are substantially prevented, and that the bending after expanded in the example 2 using two pressure receiving sections is smaller than in the example 1 using one pressure receiving section and this contributes to the pipe breakage prevention.

Table also teaches that a water pressure at the time of pipe expansion in each example is much lower than that in the comparison. The reason for this follows. In the comparison not using the pressure receiving section, the pressurized water enters through a gap between the conical surface 41*a* of the metal pipe expander 41 and the inner surface of the metal pipe 10 under expansion, and a liquid pressure (water pressure) "p" exerts on the rear end of the conical surface 41*a*. By the liquid pressure "p", the reverse propel force Q acts on the metal pipe expander 41. Consequently, a large liquid pressure "p" is required for generating the expanding force F. On the other hand, in the examples, the liquid pressure "p" applied to the expanding section 2 and therearound is blocked by the sealing action by the pressure receiving sections 3 and 23. Accordingly, the reverse propel force Q does not act on the metal pipe expander. For this reason, each example can expand the pipes at a liquid pressure (water pressure), which is lower than the liquid pressure in the comparison not using the pressure receiving section. Thus, use of the low liquid pressure "p" is allowed in the examples, so that a probability of the breakage of the metal pipe when it is expanded is further lessened.

It should be noted that the present invention is not limited to the above-mentioned embodiment, but it may variously be modified, changed and altered within the true spirits of the invention. For example, specific configurations and materials of the component parts of the metal pipe expander may be those other than the above-mentioned ones. While the expanding of the oil well pipes in diameter was described in the embodiments, it is evident that the present invention may be applied to the expanding of the metal pipes for pipe lines in chemical and petrochemical industry, and other metal pipes.

As seen from the foregoing description, a liquid pressure for driving the metal pipe expander is sealed with a sliding contact portion between the inner surface of an expanded metal pipe and a pressure receiving section, and the sliding contact portion blocks the application of the liquid pressure to the inner surface of the metal pipe located on the fore side of the sliding contact portion. Therefore, a force exerting on the metal pipe at the expansion-terminating position and therearound is lessened, thereby preventing the metal pipe from being broken when the pipe is expanded.

In addition to the above useful effects, according to the second to fourth metal pipe expanders of the invention, the bending of the metal pipe when it is bent is controlled to be small, so that the breakage of the metal pipe owing to this bending is prevented.

What is claimed is:

1. A metal pipe expander which is inserted into a metal pipe and driven to move in the axial direction of the metal pipe by a liquid pressure, comprising:

an expanding section having a conical portion of which a small diameter portion is directed to a front side; and a pressure receiving section having a cup shaped portion opened to the rear side, the outer surface of which is in slide contact with an inner surface of the metal pipe after it is expanded in diameter, said pressure receiving section being provided at an rear end of an expanding section.

2. The metal pipe expander according to claim 1, wherein a plurality of said pressure receiving sections are provided while being longitudinally and contiguously arranged.

3. The metal pipe expander according to claim 1, further comprising a guide portion being provided between said expanding section and said pressure receiving section in a state that said guide portion is in slide contact with the inner surface of said metal pipe after it is expanded.

4. The metal pipe expander according to claim 1, further comprising a guide portion having a fitting part which is provided on a fore side of said expanding section, said fitting part being brought into press contact with the inner surface of said metal pipe at a position spaced apart from said expanding section.

5. The metal pipe expander according to claim 1, wherein a conical surface of said conical portion is hardened by quenching.

6. The metal pipe expander according to claim 1, wherein said cup shaped portion gradually increases its diameter toward the rear side, and a rear end of said cup shaped portion has an outside diameter which is equal to or somewhat smaller than a diameter of a large diameter portion of said conical portion so that the rear end of said cup shaped portion slidably contacts with an inner surface of an expanded portion of said metal pipe.

7. The metal pipe expander according to claim 1, wherein said cup shaped portion has a thickness that is thinner than that of an expanded portion of said metal pipe.

8. The metal pipe expander according to claim 1, wherein an outer surface of said cup shaped portion is subjected to a surface treatment in order to secure a wear treatment.

9. The metal pipe expander according to claim 1, wherein said guide section has a fitting head that is located in front of said conical portion and is fit into said metal pipe in a state that a slight gap is present between it and the inner surface of said metal pipe.

10. The metal pipe expander according to claim 9, wherein a distance between said fitting head and said conical portion is 1.5 times or more as long as the inner diameter of said metal pipe.

* * * * *